United States Patent [19]

Paverman

[11] 4,023,325

[45] May 17, 1977

[54] LOAD BEARING REINFORCED GROUND SLAB

[76] Inventor: Grisha H. Paverman, 200 E. 64th St., New York, N.Y. 10021

[22] Filed: Nov. 11, 1975

[21] Appl. No.: 631,160

[52] U.S. Cl. ..... 52/742; 52/727; 61/35; 61/53.52

[51] Int. Cl.[2] ..... E04B 1/00; E04C 3/30

[58] Field of Search ..... 52/742, 743, 727; 264/49, 45, 196; 61/35, 39, 53.52, 53.64, 53.66, 53.62

[56] References Cited

UNITED STATES PATENTS

| | | | |
|---|---|---|---|
| 2,150,176 | 3/1939 | Levy | 52/742 |
| 3,184,893 | 5/1965 | Booth | 52/742 |
| 3,301,926 | 1/1967 | Reiland | 52/727 |
| 3,309,877 | 3/1967 | Degen | 61/35 |
| 3,720,034 | 3/1973 | Dawley | 52/742 |
| 3,886,754 | 6/1975 | Turzillo | 61/53.62 |
| 3,946,570 | 3/1976 | Freydier | 61/35 |

*Primary Examiner*—Price C. Faw, Jr.
*Assistant Examiner*—Robert C. Farber
*Attorney, Agent, or Firm*—Kirschstein, Kirschstein, Ottinger & Frank

[57] ABSTRACT

A reinforced horizontal slab having high bearing strength is created on the surface of the ground by initially forming a plurality of discrete vertically elongated reinforced zones in situ in the ground with their tops adjacent ground level and then covering the ground over and between the zones with a surfacing material constituting a slab that rests on the tops of said zones and on the ground therebetween. Each zone is a downwardly tapered concrete column having at least one vertically oriented reinforcing metal bar embedded therein. The zones are formed by a method which entails vibratorily vertically sinking a tapered hollow elongated mandrel into the ground at each zone location, vertically extracting the mandrel to leave a tapered vertical hole in the ground, filling the hole with concrete, vibratorily reinserting the hollow mandrel with a reinforcing metal bar therein and having its lower end laterally protruding from the mandrel tip, so that the concrete is expanded into the soil adjacent to the hole and the bar is vertically emplaced in the hole, vibratorily extracting the mandrel from the hole while leaving the rod in the concrete, and then allowing the concrete to set in the hole. The slab is poured on the ground surface over the tops of the columns, the slab being reinforced with a mat or reinforcing bars.

11 Claims, 9 Drawing Figures

FIG. 1
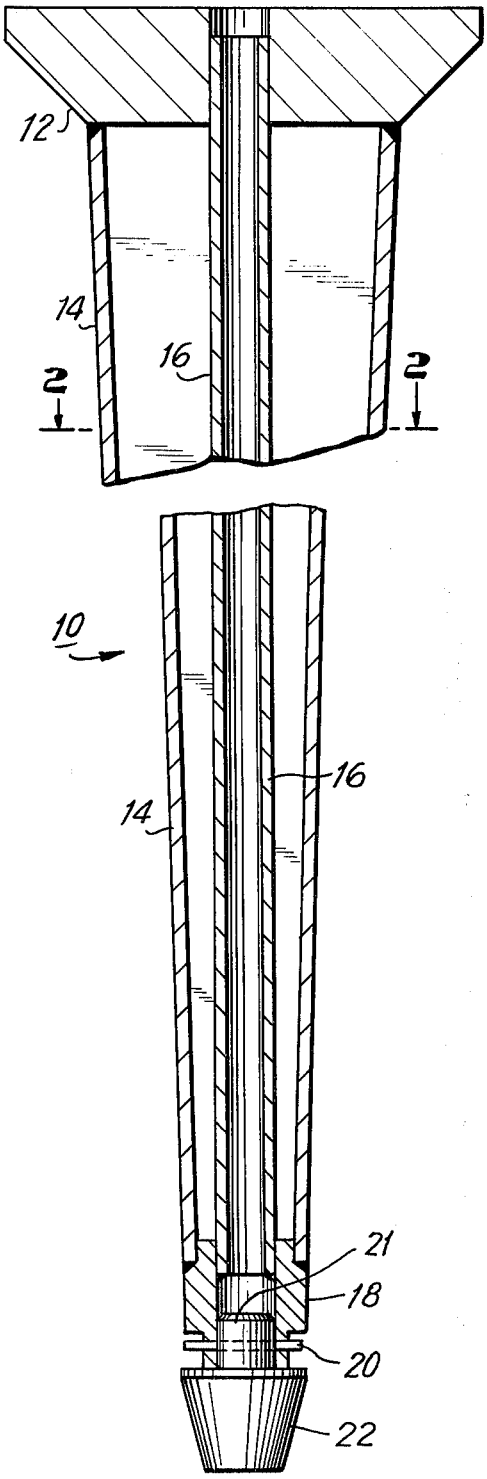
FIG. 2A
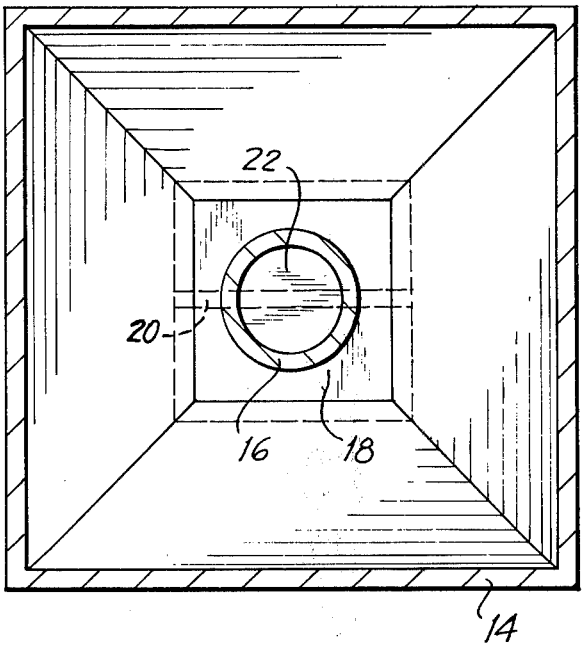
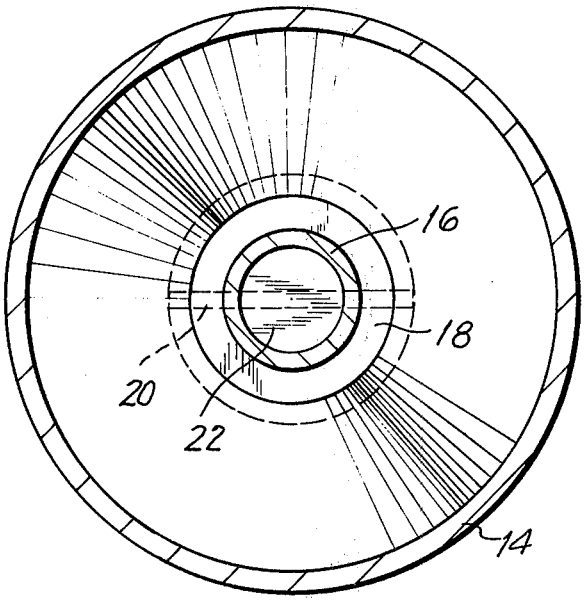
FIG. 2B

LOAD BEARING REINFORCED GROUND SLAB

BACKGROUND OF THE INVENTION

1. Field of the Invention

The invention relates to the construction of horizontal slabs on the surface of the ground, such slabs being suitable for foundations for private housing developments, in supermarkets, parking lots, and courts on which games such as tennis, basketball and handball may be played. The invention especially relates to the building of outdoor tennis courts surfaced with a mixture of pulverized rubber and clay.

2. Description of the Prior Art

The construction of on-the-ground slabs has been accomplished in the prior art in various ways. When the ground is of relatively firm consistency, the topsoil is excavated to a depth of a foot or more over the entire area to be covered by the slab. Then, tarpaper or plastic sheeting is laid down to prevent seepage of ground water. One or several layers of steel mat is laid down over the tarpaper or the like, and then surfacing material such as concrete or asphalt is poured or paved over the area to yield the finished slab. Such slabs have relatively low bearing strength, i.e., a concentrated heavy weight or sudden force applied as by the dropping of a heavy object will readily cause cracking of the slab. The effects of weather, e.g., rainfall, moisture seepage, frost, ground freeze etc., soon cause such slabs to deteriorate in service, especially in outdoor service.

SUMMARY OF THE INVENTION

1. Purposes of the Invention

It is an object of the present invention to provide an improved method for making a slab.

Another object is to make a slab having high bearing strength.

A further object is to provide a slab and method of making the slab which is less costly and faster than prior art techniques.

An additional object is to provide an improved reinforced slab and method of making the reinforced slab.

Still another object is to provide an improved method of increasing the bearing strength of the ground beneath a slab.

These and other objects and advantages of the present invention will become evident from the description which follows:

2. Brief Description of the Invention

In the present invention, an improved reinforced slab is made by initially forming a plurality of discrete reinforcing zones in situ in the area to be covered by the slab. The zones extend vertically into the ground below the surfacing material, which is typically concrete or terrazzo or other cementitious material, asphalt, etc. In the case of outdoor courts for games such as tennis, basketball or handball, the preferred surfacing material is a mixture of pulverized rubber and clay or other clay-like composition, commonly known as Har-Tru.

Each reinforcing zone is a tapered concrete column containing at least one vertically oriented reinforcing metal bar, usually composed of steel. As will appear infra, in order to effectively emplace the bar, it is provided with a lower horizontal or lateral extension. The column is formed by vertically sinking a tapered hollow mandrel into the ground at the location of the zone by applying a vertically vibratory force to the mandrel, vertically vibratorily extracting the mandrel from the ground to leave a tapered vertical hole, filling the hole with concrete, vertically sinking the mandrel into the concrete-filled vertical hole by applying a vertically vibratory force to the mandrel, with the mandrel having a reinforcing metal bar inserted therein vertically, so that the concrete is expanded into the soil adjacent to the hole and the bar is vertically emplaced in the hole, generally centrally within the concrete filling, vibratorily extracting the mandrel from the hole and allowing the concrete to set. The lower lateral extension of the bar is located near the tip of the mandrel during its sinking into the concrete-filled hole so that the extension is anchored in the concrete and will hold the rod in position as the mandrel is extracted. The surfacing material, including reinforcing means, is applied to the ground after the concrete has set.

The procedure and finished article of manufacture of the present invention provides several salient advantages. The slab is relatively inexpensive to construct and requires a minimal amount of labor, since most of the fabrication is accomplished by machine, i.e., the vibrating mandrel and a concrete laying machine. The finished slab has a high bearing strength and is not readily subject to cracking, because the tapered concrete columns formed in situ serve to distribute the load more evenly to the bearing strata in the ground, and also because the second application of the vibrating mandrel, i.e., into the concrete-filled hole, serves to disperse and expand the concrete into the ground and also to consolidate the soil. Thus, the present technique allows the transfer of the foundation loads from the surface to acceptable bearing capacity from 3 to 5 tons per square foot through the system of installing the concrete columns or piles up to 10 feet into the ground to a bearing stratum. The settlement of soil is greatly reduced by the present method because of pre-compaction as the concrete columns are installed, and the bearing strength is highly increased. The concrete columns or piles are installed in a very short period of time, typical production rates being up to 10 units per hour or about 60 piles or columns in 8 hours. Typical bearing loads are between three and twelve tons per pile depending on the soil quality. The invention is generally applicable to the production or construction of various types of slabs or analogous ground cover structure, such as foundations for private housing and developments in supermarkets; parking lots or small parking areas for the parking of cars, trucks, etc., truck loading and/or unloading areas; courts for outdoor games such as tennis or the like as mentioned supra, in which case the surfacing material is preferably a mixture of pulverized rubber and clay, or the like; sidewalks or walkways, etc.

BRIEF DESCRIPTION OF THE DRAWINGS

Referring now to the drawings,

FIG. 1 is an axial sectional elevation fragmentary view of a typical mandrel;

FIG. 2A is a sectional view taken substantially along the line 2—2 of FIG. 1;

FIG. 2B is a view similar to FIG. 2A of a mandrel embodying a modified form of the invention;

DETAILED DESCRIPTION OF THE PREFERRED EMBODIMENTS

Figure 3:
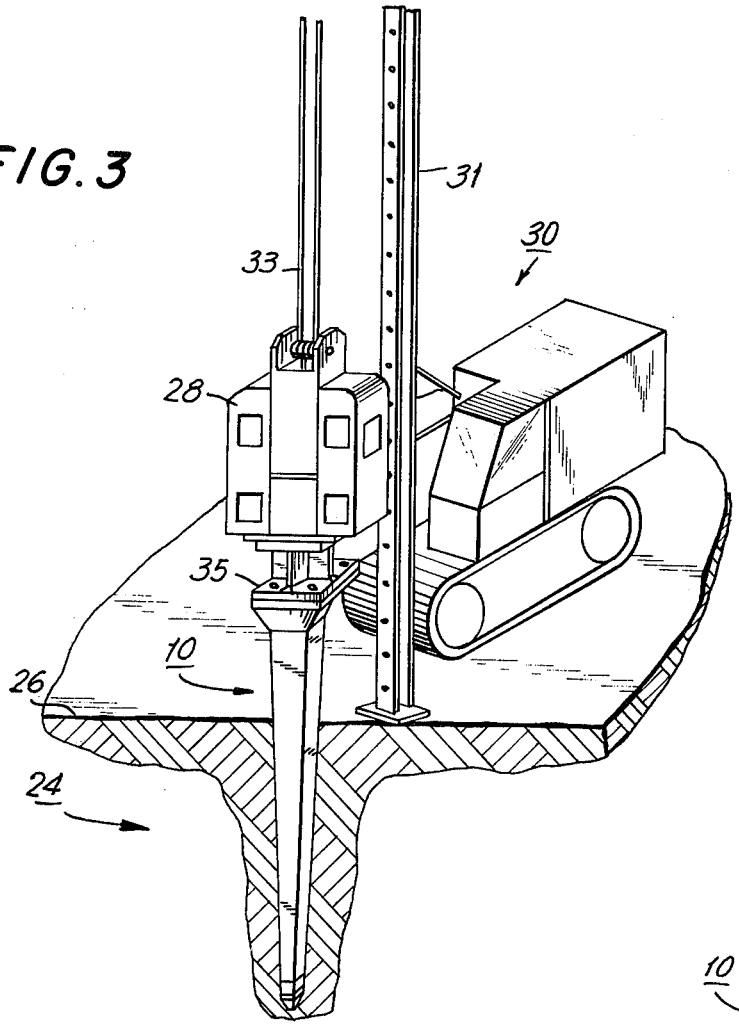
FIG. 3 is an isometric view of equipment for sinking and extracting the mandrel vibratorily, the same being illustrated during the first sinking step.

Referring now to FIG. 1, a mandrel 10 is shown with its middle portion omitted, and with appurtenances attached for driving a hole in the ground. The mandrel 10 is of generally tapered configuration, and is provided with a tapered upper weighted steel base 12, a steel tapered outer shell or member 14 generally of square (see FIG. 2A) or circular (see FIG. 2B) horizontal cross-section, a steel inner pipe or tube 16, coaxial with member 14, and a lower steel collar 18. The base and collar are secured as by welding to the opposite ends of the shell 14 and tube 16. A steel pin 20 serves to attach a steel driving point or driving tip 22 to the collar 18. Other means such as bolting or a clip may be provided to attach driving point 22 to collar 18.

Typically the tip has an inwardly extending plug 21 that fits snugly into a vertical bore in the collar and may butt against the lower end of the pipe 16. In this position horizontal bores in the plug and collar are aligned to receive the pin 20.

In the operation, the mandrel 10 with the tip in place is vertically oriented and moves downwards into the ground by application of a vertically vibratory force, so that the point 22 sinks its way into the ground while the member 14 expands the initial opening. The sinking is continued until the base 12 has entered the ground up to its top surface.

FIG. 3 illustrates a typical apparatus for making a hole in an area of ground 24 by sinking the mandrel 10 of FIG. 1 vertically downwards through a ground surface 26. A vertically vibratory force is applied to the top of the vertically oriented mandrel 10 by a unit 28 which is commonly termed a vibrodriver. Typical vibrodrivers are shown and described in U.S. Pat. Nos. 3,564,932; 3,433,311; 3,394,766; 3,391,435 and 3,368,632. The vibrodriver is mounted on a mobile carrier 30 that includes a vertical beam 31 which in use has its lower end bearing on the ground surface and supports a pulley (not shown) at its top. A cable 33, trained about the pulley, engages a sheave on the vibrodriver. Power means, not shown, enables the beam to be raised and lowered for movement to a desired location and also to enable the vibrodriver to be raised and lowered for the same purpose. A clamp 35 detachably secures the top of the mandrel to the vibrodriver. A compressor (not shown) on the carrier supplies compressed air or oil under pressure to drive fluid motors on the vibrodriver thereby supplying a vertically reciprocating force to the mandrel. This force allows the mandrel to sink into the ground under its weight and that of the vibrodriver. The vibrating force also loosens the compacted structure of the ground.

After the mandrel 10 has sunk into the ground to the proper depth, e.g., 10 feet, or to a resistant or bearing stratum, the cable 33 is operated to lift the mandrel 10 vertically upwards from the ground, leaving a tapered hole in the ground. The motors of the vibrator may be deactivated during lifting if the taper of the mandrel is sufficient, as shown, to disengage the sides of the mandrel from the sides of the hole after the lift has commenced. If the taper is so slight that engagement remains during lifting, the vibrodriver motors are left actuated to further loosen the ground.

Figure 4:
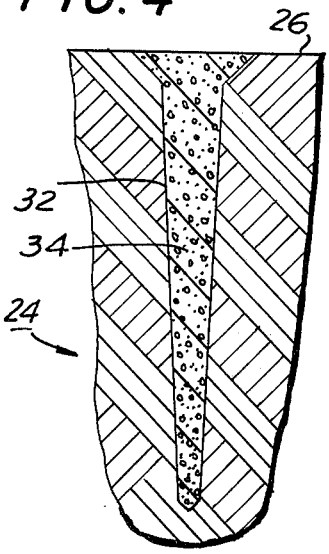
FIG. 4 is a vertical sectional view through the ground after a mandrel has been vibratorily sunk and extracted and after the remaining hole has been filled with concrete.

FIG. 4 shows hole 32 formed by the mandrel, after the hole 32 has been filled with fluent concrete 34. The term concrete will be understood to be used in a general sense, i.e., the filling 34 could consist generally of any type of concrete, cementitious material, cement, grout, mortar, etc., or generally of any material which hardens and sets on standing or with the aid of a chemical reactant.

Figure 5:
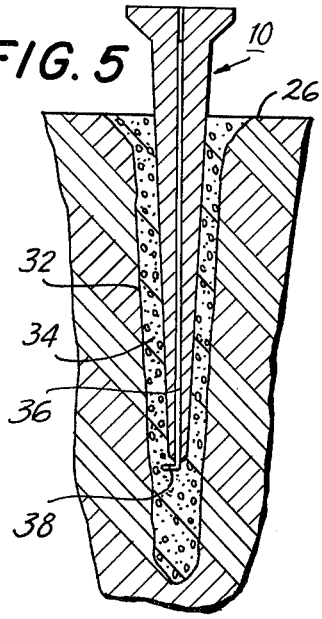
FIG. 5 is a view similar to FIG. 3, but showing the subsequent stage of forcing in the mandrel to expand the concrete laterally into the ground and to insert a reinforcing rod.

FIG. 5 shows the subsequent step of re-introducing the mandrel into the hole after the concrete has been poured but has not yet seen. As will appear infra, the mandrel 10 of FIG. 5, prior to its reintroduction in the hole, has been modified to accommodate and include a steel reinforcing bar or rod 36. The FIG. 5 step serves to induce the consolidation of the soil adjacent the hole 32, e.g, engender seepage of the still fluid concrete transversely into the adjacent soil and to compact the fluid concrete and the ground around the hole.

Figure 6:
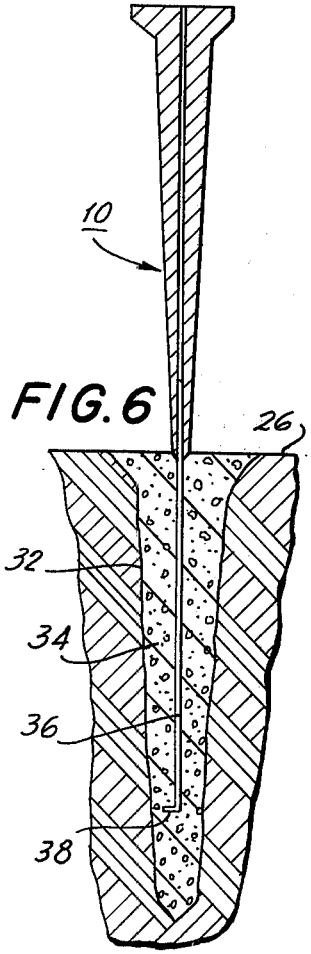
FIG. 6 is a view similar to FIG. 4, but showing the mandrel being extracted for the second time, now to leave the reinforcing rod in place.

FIG. 6 illustrates the final removal of the mandrel 10, from the new somewhat enlarged hole 32 which has concrete diffused transversely in the ground. During this second extraction, the vibrodriver motors may be actuated to enhance the compactions of the concrete and the ground. The reinforcing metal bar or rod 36 is in place after having been inserted by the mandrel 10 into the concrete filled hole during the FIG. 5 step concomitantly with the expansion of the concrete 34 in said hole. The bar 36 is generally vertical oriented centrally in the hole 32. An auxiliary bar or bars, not shown, may also be inserted into hole 32 as desired, either by hand or by the use of suitable emplacing equipment such as jack hammer. The bar 36 is provided with a lateral extension 38 at its lower end, which in this embodiment of the invention is a short horizontal leg of the bar formed by bending the lower end of the bar 36.

As mentioned supra, the bar 36 is emplaced by the mandrel prior to the FIG. 5 step. This is accomplished, referring now to FIG. 1, by removing the pin 20 from the mandrel 10 and tip 22 after the FIG. 3 step of forming the hole and then extracting the mandrel therefrom. This allows removal of the tip 22. Removing the tip 22 clears a vertical passage through collar 18 into the central tube 16. The bar 36 is then inserted vertically and coaxially upwards through the collar 18 and into the tube 16 until the extension 38 contacts the collar 18. Preferably a washer 37 (see FIG. 7) is threaded onto the reinforcing rod before the rod is introduced into the collar 18 and the lower end of the tube 16 to minimize the entry of the still fluent concrete into the mandrel as the mandrel with its ensheathed rod is being vibratorily sunk into the concrete filled hole. The mandrel 10 is now ready for re-insertion into hole 32 in accordance with FIG. 5 as described supra.

Figure 7:
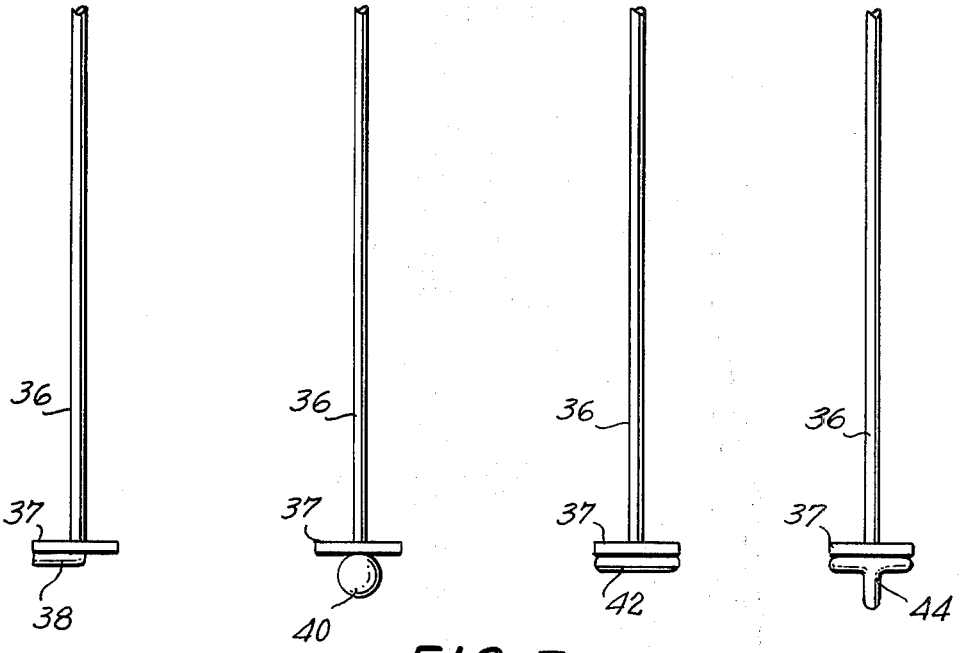
FIG. 7 illustrates typical reinforcing bar configurations.

FIG. 7 illustrates various alternative configurations of the lateral extension at the lower end of the bar 36. The lateral extension 38, as described supra, is a simple substantially horizontal leg in one piece with the lower end of the bar. The lateral extension 40 is in the form of a ball or bulb, which may either be welded to the lower end of bar 36, or else formed in situ by working and forming the lower end of bar 36 at elevated temperature, or attached by other means known to the art. Similar considerations apply to the headed tip configurations of lateral extensions 42 and 44, i.e., disc like tip 42 may be formed by flattening the end of bar 36 or by welding a disc to the end of bar 36, and flange tip 44 may be emplaced by welding a flange or large washer to bar 36 near but above the lower end of the bar.

The lateral extension, regardless of its form, acts to anchor the rod in the concrete as the mandrel is being extracted so that the rod is left in place. The length of the rod is selected to locate the top of the rod, after extraction of the mandrel, near the top of the concrete in the filled hole. After extraction of the mandrel from the concrete filled hole, extraneous concrete above the surface of the ground is removed, leaving the top of the concrete substantially level with the ground. If desired, the top of the rod may project from the top of the concrete for assembly purposes. Optionally the top of the rod may be threaded likewise for assembly purposes.

The concrete in the hole is now permitted to set, forming an in-the-ground column, fabricated in situ, and in initimate load sharing contact with the ground which now is highly consolidated, and the column being of greater cross-sectional dimensions than the mandrel due to insinuation of the concrete into the surrounding ground.

A large number of columns are thus made, being arranged in suitable mutual relationship to provide load bearing zones for the structure they are to support.

Figure 8:
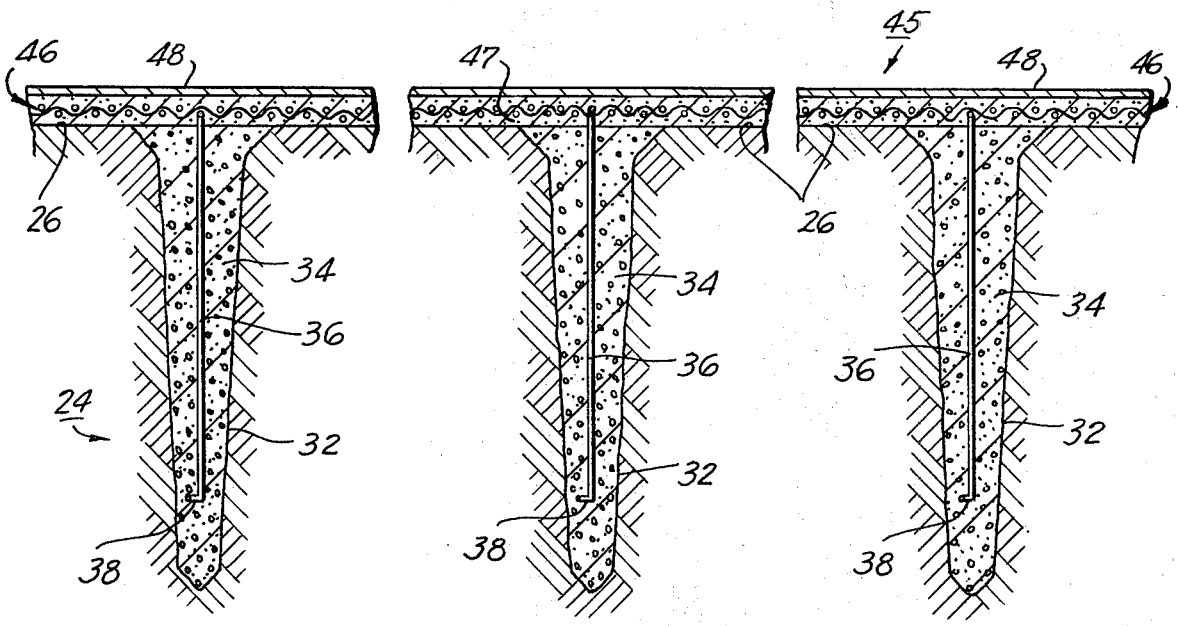
FIG. 8 is a vertical cross-section through a typical finished slab.

FIG. 8 shows a portion of a finished slab 45 which is a typical structure to be supported, the slab being adapted for use as the playing surface of a tennis court. The upper end of each reinforcing bar 36 extends a short distance, e.g., two inches, above the ground surface level 26. A generally horizontal mat 46, which is composed of iron or steel or other suitable material of construction for mats or meshes, and which is emplaced usually after the concrete filling 34 has set, is laid on the ground. It may be secured, as by welding to the tops of the reinforcing bars. Alternatively, assembly members such as horizontal reinforcing metal bars may be criss-crossed on the ground and, optionally attached to the upper ends of the bars. The upper ends of bars 36 may be below the ground surface level 26 in suitable instances.

A horizontal filling of concrete or other suitable material 47 is poured or laid over and about the mat 46 and this, when set, may constitute the finished slab, however, in this FIG. 8 embodiment the slab is topped by providing an additional horizontal layer 48 of surfacing material above mat 46. The layer 48 may consist of any suitable surfacing material as mentioned supra, e.g., a mixture of pulverized rubber and clay.

The specifications of a typical slab installation will now be described;

EXAMPLE

The side of the mandrel 10 have a taper of 5° to 8° from the vertical, and the mandrel is 10 feet in overall length. The diameter at the top of the mandrel is 12 inches. A plurality of columns are provided in an orthogonal pattern over a rectangular area, with the holes spaced 10 feet apart. The concrete reinforcing steel. bars were one-half inch in diameter. The slab is a 6 inch thick layer of concrete. The surfacing material was a mixture of pulverized rubber and clay, and the finished slab was used as an outdoor tennis court.

It thus will be seen that there is provided a method of constructing a load bearing column in situ in the ground for a slab, and a reinforced ground slab, which achieves the various objects of the invention and which is well adapted to meet the conditions of practical use.

As various possible embodiments might be made of the above invention, and as various changes might be made in the embodiment above set forth, it is to be understood that all matter herein described or shown in the accompanying drawings is to be interpreted as illustrative and not in a limiting sense. In this regard, it will be appreciated that the term vertical vibratory force embraces not only a vertical sinusoidal force generated by oppositely spinning eccentric weights of one or more pairs of like weights but also a vibro-percussion force, such as is applied in pneumatic devices like a pneumatic hammer or drill. Thus, a vibro-percussive force would be applied in an analogous manner to the mandrel as a combination of a vertical vibratory percussive force as generally described in the U.S. Pat. No. 3,394,766 and other patents mentioned above.

In addition, it will be understood that the reinforcing rod or bar may alternatively be separately emplaced in the hole using a jack-hammer or pneumatic drill, or a pile driver or even by hand using a sledge hammer or the like, rather than by the preferred embodiment in which the mandrel is employed for this purpose. Numerous other alternatives within the scope of the present invention will occur to those skilled in the art.

Having thus described the invention, there is claimed as new and desired to be secured by Letters Patent:

1. A method of constructing a load bearing column in situ in the ground, said method comprising vertically sinking a downwardly tapering hollow elongated mandrel into the ground by applying to said mandrel a vertically vibratory force, vertically extracting said mandrel from the ground to leave a downwardly tapering vertical hole, inserting a reinforcing bar in the mandrel with the lower end of the bar extending laterally from the mandrel near the tip thereof, substantially filling said vertical hole with fluent concrete, vertically sinking said mandrel into said vertical hole a second time by applying to said mandrel a vertically vibratory force and with the reinforcing bar therein, whereby the concrete is expanded into the soil adjacent to said hole and said bar is emplaced in said hole, extracting said mandrel from said hole a second time while leaving the bar in the hole with its lower end anchored in the concrete to draw the bar out of the mandrel as the mandrel is extracted from the concrete filled hole, and allowing the concrete to set so as to form the load bearing column in situ.

2. The method of claim 1, in which the metal bar is steel.

3. The method of claim 1, which further includes similarly forming a plurality of additional load bearing columns in situ in preselected locations in the ground, spaced from one another and from the first load bearig column.

4. A method of fabricating a ground level slab comprising forming a large number of load bearing columns in situ in the ground as set forth in claim 3 and thereafter applying a thick layer of a suitable material on the ground over the area defined by the columns.

5. The method of claim 4, in which said settable material is selected from the group consisting of asphalt, terrazzo and concrete.

6. The method of claim 4, in which the settable material is concrete.

7. The method of claim 6, in which the slab has a surfacing material applied thereto.

8. The method of claim 7, in which the surfacing material is a mixture of pulverized rubber and clay.

9. The method of claim 5, in which a horizontal reinforcing assemebly is incorporated in the slab prior to setting.

10. The method of claim 9, in which the horizontal reinforcing assembly is a metal mat.

11. A method of constructing a load bearing column in situ in the ground, said method comprising vertically sinking a downwardly tapered elongated mandrel into the ground by applying to said mandrel a vertically vibratory force, vertically extracting said mandrel from the ground, substantially filling said vertical hole with fluent concrete, vertically sinking said mandrel into said vertical hole a second time by applying to said mandrel a vertically vibratory force, whereby the concrete is expanded into the soil adjacent to said hole, extracting said mandrel from said hole a second time, whereby a concrete-filled hole is provided, emplacing a reinforcing bar in the concrete-filled hole, and allowing the concrete to set so as to form the load bearing column in situ.

* * * * *